US009745783B2

(12) United States Patent
Barmscheidt

(10) Patent No.: US 9,745,783 B2
(45) Date of Patent: Aug. 29, 2017

(54) MOTOR VEHICLE DOOR LOCK AND METHOD FOR ELECTRICALLY ACTUATING A LOCKING MECHANISM

(71) Applicant: Kiekert Aktiengesellschaft, Heiligenhaus (DE)

(72) Inventor: Christian Barmscheidt, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 86 days.

(21) Appl. No.: 14/381,412

(22) PCT Filed: Feb. 26, 2013

(86) PCT No.: PCT/DE2013/000104
§ 371 (c)(1),
(2) Date: Aug. 27, 2014

(87) PCT Pub. No.: WO2013/127383
PCT Pub. Date: Sep. 6, 2013

(65) Prior Publication Data

US 2015/0084352 A1 Mar. 26, 2015

(30) Foreign Application Priority Data

Feb. 29, 2012 (DE) ..... 10 2012 003 854

(51) Int. Cl.
*E05C 3/06* (2006.01)
*E05B 81/00* (2014.01)
(Continued)

(52) U.S. Cl.
CPC ..... *E05B 81/00* (2013.01); *E05B 81/15* (2013.01); *E05B 81/64* (2013.01); *Y10T 292/1082* (2015.04)

(58) Field of Classification Search
CPC ..... E05B 81/06; E05B 81/68; E05B 81/36; Y10T 292/1082; Y10T 292/1021; Y10S 292/23
(Continued)

(56) References Cited

U.S. PATENT DOCUMENTS 5,802,894 A * 9/1998 Jahrsetz ..... E05B 77/48 292/144
2005/0200137 A1 9/2005 Nelsen
2010/0244466 A1* 9/2010 Tomaszewski ..... E05B 77/26 292/201

FOREIGN PATENT DOCUMENTS

DE 102007060915 A1 6/2009
EP 1391573 A2 2/2004
FR 2775016 A1 8/1999

OTHER PUBLICATIONS

Machine Translation of DE102007060915A1 by Lexis Nexis Total Patent on Aug. 27, 2014.
(Continued)

*Primary Examiner* — Mark Williams
(74) *Attorney, Agent, or Firm* — Woodard, Emhardt, Moriarty, McNett & Henry LLP

(57) ABSTRACT

The invention relates to a motor vehicle door lock and to a method for electrically actuating a locking mechanism in said type of motor vehicle door lock. Said motor vehicle door lock comprises a locking mechanism and an electric drive (1, 2, 3) for the locking mechanism. It also comprises at least one signal transmitter (8) for impinging upon the electric drive (1, 2, 3). According to the invention, a first flank ($F_S$) and also a second flank ($F_E$) of a signal (S) generated by the signal generator (8) are evaluated for controlling the electric drive (1, 2, 3).

15 Claims, 3 Drawing Sheets

Figure 1:
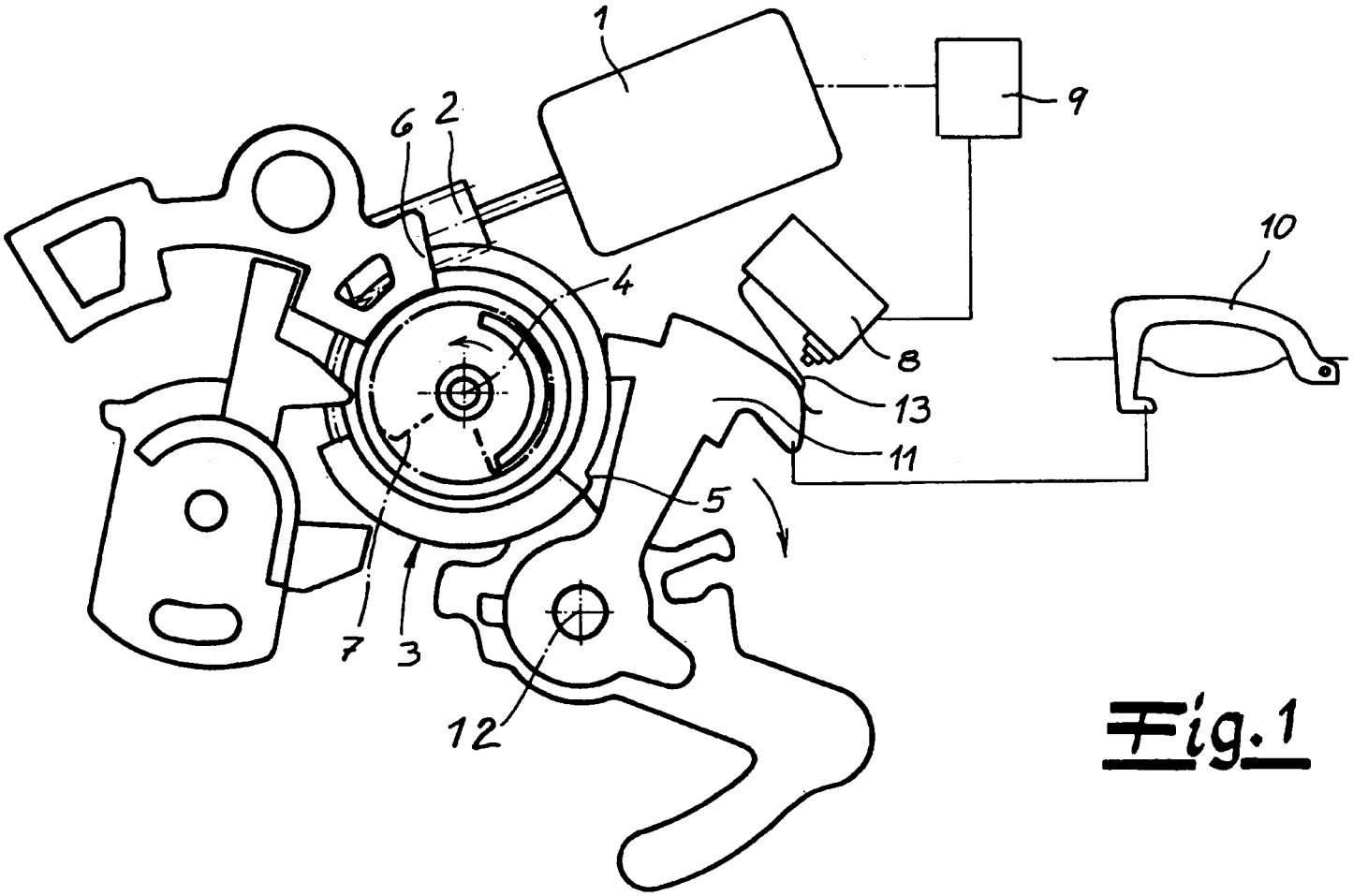

(51) Int. Cl.
*E05B 81/14* (2014.01)
*E05B 81/64* (2014.01)

(58) Field of Classification Search
USPC ..... 292/201
See application file for complete search history.

(56) References Cited

OTHER PUBLICATIONS

Machine Translation of EP1391573A2 by Lexis Nexis Total Patent on Aug. 27, 2014.
Machine Translation of FR2775016A1 by Lexis Nexis Total Patent on Aug. 27, 2014.

* cited by examiner

MOTOR VEHICLE DOOR LOCK AND METHOD FOR ELECTRICALLY ACTUATING A LOCKING MECHANISM

REFERENCE TO RELATED APPLICATIONS

This application is the U.S. national stage application of International Patent Application No. PCT/DE2013/000104, filed Feb. 26, 2013, which claims priority of German Application No. 10 2012 003 854.2, filed Feb. 29, 2012, which are hereby incorporated by reference.

The invention relates to a motor vehicle door lock comprising a locking mechanism and an electric drive for the locking mechanism and at least one signal generator for impinging upon the electric drive. The object of the invention is also a method for motorized or electric actuation of a locking mechanism of a motor vehicle door lock in which the electric drive is impinged upon by at least one signal generator.

A motor vehicle door lock and a respective method for electric actuation of a locking mechanism of the aforementioned design is disclosed in DE 196 00 524 A1. The document describes a lock that can be actuated electrically and also has an emergency opening. Upon actuation of a handle, such as an internal door handle or an external door handle, the pawl as a component of the locking mechanism is electrically moved at least into an opening position with the aid of an actuator. This has generally proven to be successful and is referred to as so-called "electric opening" of the motor vehicle door lock, as the actual opening process is not carried out manually via an actuation lever chain but instead without any mechanical connection between the handle and the locking mechanism (solely) by electrical means with the aid of an electric drive.

In a comparable motor vehicle door lock as disclosed in DE 203 07 347 U1, the electric drive acts directly or indirectly on the pawl with the aid of a cam in order to open the rotary latch. In the disengaged position of the pawl, the cam is held with the aid of an engaging blocking means until the opening rotary latch separates the blocking means from the cam. In this way, a reliable disengaging of the pawl is produced and, in particular, without a so-called intermediate catch engagement.

This intermediate catch engagement is a process during which the disengaged pawl comes into mechanical contact again with the opening rotary latch. This can, for instance, occur if the handle actuated for opening the locking mechanism is released and is then acted upon again and whilst the locking mechanism is still opening or the initial introduced opening process of the locking mechanism has not been completed as yet. In any case, this intermediate catch engagement potentially delays or completely prevents the opening movement of the rotary latch. The opening process is also in most cases accompanied by unwanted noises. Intermediate catch levering often occurs during an extremely slow opening process.

In order to prevent this intermediate catch engagement, the known and proven teaching of DE 203 07 347 U1 discloses a blocking means consisting of a two-arm blocking lever, cooperating with the cam and also the rotary latch. Although this provides the required functionality (connecting of the intermediate catch engagement), a considerable design effort is required as the electric drive and the rotary latch must be adapted to the additional blocking lever as well as the blocking lever having to be provided and integrated. As a result, a relatively large space is required for the known motor vehicle door lock, which given the compact space available inside a motor vehicle door becomes increasingly problematic. The invention aims to remedy this situation.

The invention is based on the technical problem of further developing such a motor vehicle door lock so that installation and manufacturing costs are reduced whilst a reliable functioning is maintained and the aforementioned intermediate catch engagement no longer being required.

In order to solve this technical problem, a generic motor vehicle door lock of the invention is characterized by two flanks of a signal generated by a signal generator being evaluated for actuating the electric drive.

The electric drive is generally an electric opening drive, i.e. a drive suitable for electric opening of the locking mechanism. The invention is, however, not limited to this as the electric drive generally serves or can also serve to provide the unlocking and/or locking function of the locking mechanism. Generally, the electric drive serves, however, to open the locking mechanism. In order to achieve this, the electric drive generally acts on an actuating lever, which in turn lifts the pawl off the rotary latch so that it can open with the aid of a spring. The electric drive can, however, generally also act on the pawl to open it.

As part of the invention, the signal generated by the signal generator is analyzed for actuating the aforementioned electric drive. In this context, the signal generator interacts as usual with a handle and/or a lever connected to the handle. The signal generator can also contain a leaf spring for its actuation. In this case the handle acts on said connected lever, which in turn impinges on the signal generator.

The lever can be a blocking lever interacting with the electric drive. Typically the blocking lever ensures that the electric drive is blocked if the handle is not impinged on. As a result, any incorrect energizing of the electric drive can be combated by the design. In the invention, such incorrect energizing does not cause the electric opening of the locking mechanism as the blocking lever retains or blocks the electric drive in this case. Only when the handle is operated and also impinges upon the blocking lever does the lever leave the electric drive allowing the electric drive to operate the locking mechanism as intended. This provides a particular reliable operation.

Of special significance is the circumstance that the signal generator generally assigned to the handle or the lever or blocking lever generates a signal with two flanks and that, according to the invention, both flanks are evaluated. In prior art embodiments, these flanks are of no relevance as only the actuation of the signal generator as such is of importance.

In the invention, an actuation signal produced by a signal generator or a micro switch used in most cases at this point is examined and evaluated. The actuation of such a signal generator or micro switch corresponds to the signal starting with one flank with an energizing time x for the drive—also taking into consideration effects of wear on the drive—in order to reach the end position. After the energizing time x, the drive is short-circuited so that it is retained in its end position. The signal generator is no longer impinged upon by a second flank. The short-circuit condition is removed and a new signal can be accepted for the actuation of the drive. In the invention, the electric drive is now started with the aid of the first flank. The second flank, on the other hand, switches off the short-circuit condition or proceeds in such a way that the short circuit is rendered ineffective and the drive cannot be restarted.

In general, the electric drive moves into a holding phase after a start phase. The start phase corresponds to a set starting time, starting with the first flank of the signal generator. As the signal of the signal generator is typically evaluated in a connected control unit, which in turn impinges upon the drive, the said starting time can be easily stored in the control unit and applied with its help.

The holding phase continuous directly from the start phase. This does, however, depend on the time required by the electric drive for fully opening the locking mechanism in the described example for moving the pawl into a position in which it is fully lifted off the rotary latch (end position). In contrast to the start phase, no time is specified for the holding phase and is, in principal, also not limited in any way. Instead, only the start of the holding time is certain at the end of the start phase. The holding phase ends as soon as the signal generator or the signal generated by it shows the second flank. Like the first flank, also the second flank of the signal generator is registered and evaluated accordingly. So a soon as the second flank is detected, the control unit ensures that the holding phase is ended and a new start can be implemented.

This change of flanks is typically associated with the signal generator being directly or indirectly impinged upon by the handle (internal and/or external door handle) operated to open the locking mechanism. In contrast, the second flank of the signal of the signal generator corresponds to the handle being released and returning, for instance, with the aid of a spring, to its starting or base position.

Where such a change of flanks is detected during the start phase and within the starting time, this influences the functionality. In other words, the change of flanks is in this case evaluated by the control unit. This ensures that the power supply to the electric drive is stopped and that a new starting process can be initiated. This is due to the fact that the start phase completed in the starting time ensures that the electric drive can be moved from its base to its end position without interference. In the example, the end position of the electric drive corresponds to the pawl being lifted off the rotary latch, thus allowing the rotary latch to be opened with the aid of a spring. In contrast, the base position corresponds to the position in which the electric drive starts and in which the locking mechanism is (still) unaffected. The holding phase of the invention that continues until a flank change is no longer generated at the signal generator, ensures that an intermediate catch engagement does not take place.

Generally, the electric drive consists of at least one electric motor driving a worm gear and a driven pulley meshing with the worm gear. The driven pulley can also contain an opening shape or opening cam, which during electric opening cooperates with the triggering lever impinging upon the locking mechanism or acts directly on the locking mechanism, for instance, on the pawl. The invention also allows the use of a multi-stage gearbox.

The invention also covers the aforementioned method for electric or motorized actuation of a locking mechanism in a motor vehicle door lock, containing the aforementioned characteristics. As part of this method, the electric drive completes a start phase initiated by the flank change of the signal generator after which it enters a holding phase which ends after another flank change. At the end of the holding phase, the electric drive is moved into a neutral or its base position. In this neutral or base position, the electric drive can process a new start command or an opening process initiated by the handle. In order to ensure that the electric drive can be moved from its end position into the neutral or base position, the electric drive is typically acted upon by the force of a spring. The spring can be, in particular, a centre/zero spring, advantageously integrated in the driven pulley.

The holding phase of the electric drive generally corresponds to a short circuit of the electric motor as part of the electric drive. This short-circuit of the electric motor ensures that the electric drive carries out a holding function in relation to the locking mechanism impinged upon by said drive. This holding function ensures that the pawl, assisted by the electric drive, is and remains still lifted off the rotary latch during the holding phase, even when the rotary latch has already been opened with the aid of a spring.

As an alternative to the short circuit, a low-voltage pulse control of the drive can also be used as part of the invention.

Only once the second flank of the signal generator is detected by the handle or by the signal generator acted upon by the handle, is the holding phase terminated. This ensures that the lifted off pawl does or can under on circumstances come into mechanical contact with the opening rotary latch. As a result, the rotary latch can at all times open without delay and is not impeded in its opening movement. These are the main advantages of the invention.

Figure 2:
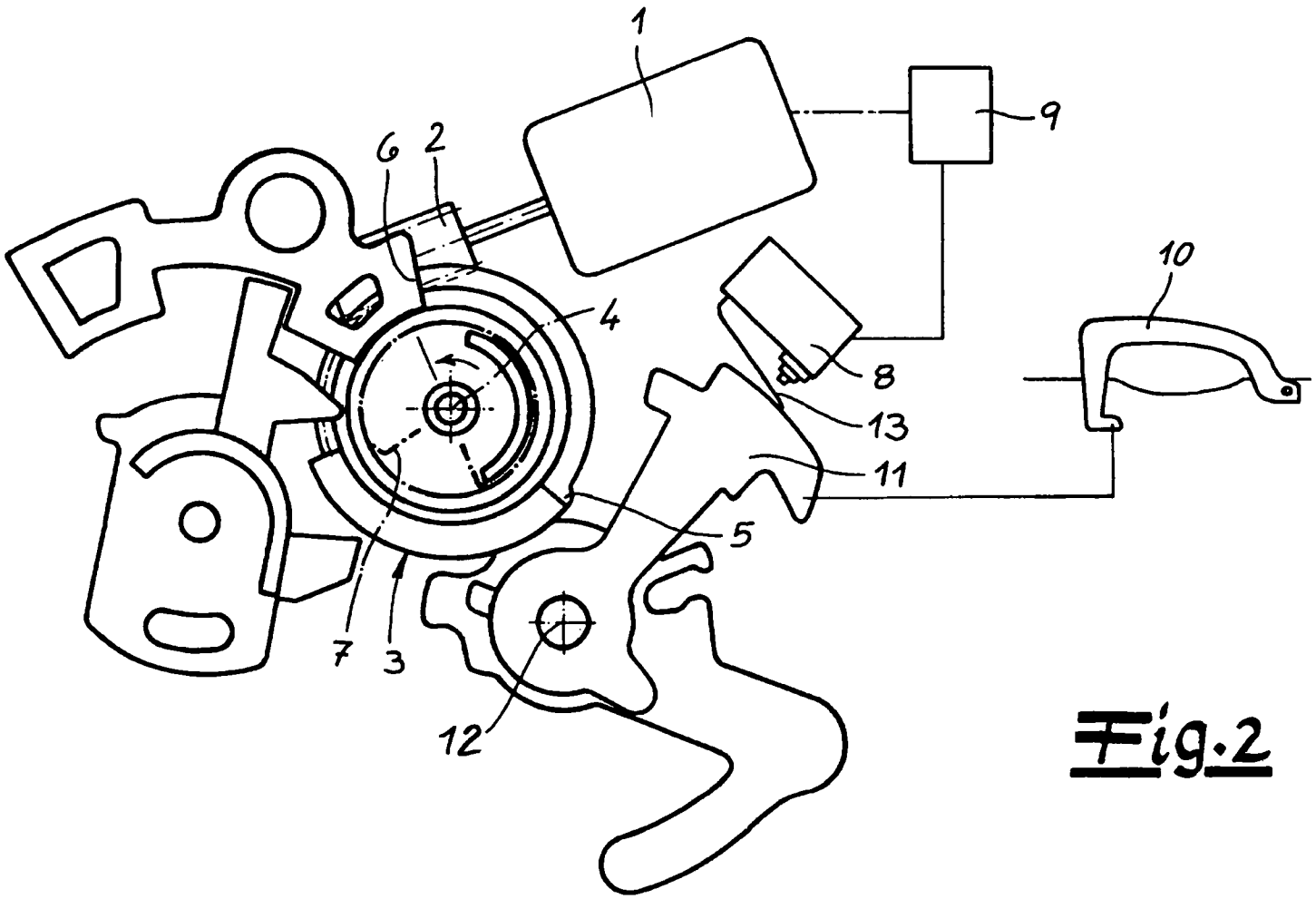
Figure 3:
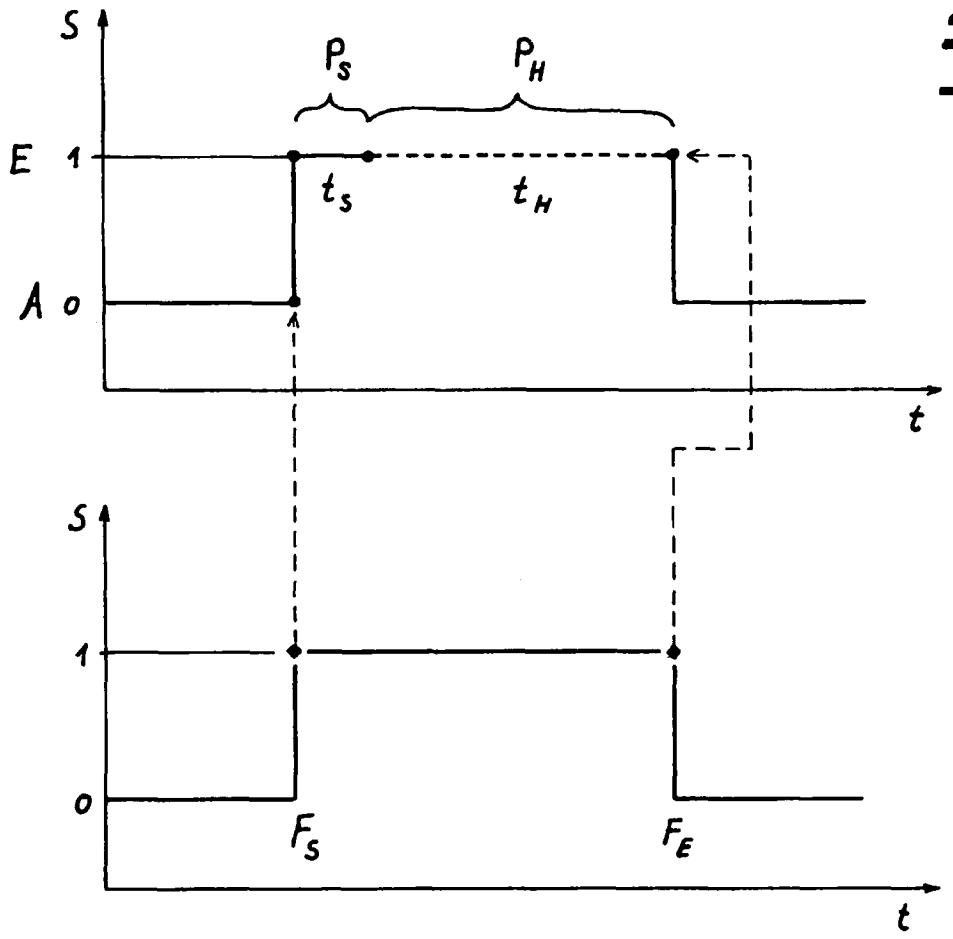

Below, the invention is explained in detail with reference to a drawing showing only one embodiment, in which:

FIGS. 1 and 2 show the motor vehicle door lock of the invention in different functional positions and FIG. 3 shows two principal time diagrams explaining the opening process.

FIGS. 1 and 2 show a motor vehicle door lock containing a not expressly shown locking mechanism. The locking mechanism comprises actually as usual a rotary latch and a pawl. The pawl is directly or indirectly acted upon by an electric drive 1, 2, 3. The electric drive 1, 2, 3 comprises an electric motor 1, a worm gear 2 acted upon by the electric motor 1 as well as a driven pulley 3 meshing with the worm gear 2.

As a result, the driven pulley 3 can rotate around its axis 4. Rotary movements of the driven pulley 3 around axis 4 in counter-clockwise direction result in the said pawl being directly or indirectly lifted off the rotary latch by a not expressly shown triggering lever. As soon as the pawl is no longer engaging the rotary latch or is lifted off it, the rotary latch can be opened with the aid of a spring and release a previously retained closing bolt. As a result, the locking mechanism is open. This basic functionality is known and disclosed in detail in the prior art documents of DE 196 00 524 A1 or of DE 203 07 347 U1 already mentioned above.

The lifted-off position of the pawl in relation to the rotary latch corresponds to the electric drive 1, 2, 3 or the stop 5 of its driven pulley 3 being moved in counter clockwise direction against the counter stop 6, fixed to the housing. The displacement from the base position (neutral position) or starting position A of the electric drive 1, 2, 3 or of the driven pulley 3 shown in FIGS. 1 and 2 into the aforementioned stop position (end position E) with stop 5 moved against the counter stop 6, is also apparent from FIG. 3

The top diagram of FIG. 3 shows the base position or starting position A and the stop position or end position E of the electric drive 1, 2. 3. If the electric drive 1, 2, 3 is no longer in the stop or end position E or if the associated electric motor 1 is no longer impinged upon, a spring 7 only indicated in FIGS. 1 and 2 ensures that the electric drive 1, 2, 3 assumes its base position or starting position A with the aid of a spring.

For this purpose, the spring 7 is designed as a centre/zero spring 7, ensuring irrespective of the direction of actuation of the electric drive 1, 2, 3 or the direction of rotation of the driven pulley 3 around its axis 4, that once the electric drive 1, 2, 3 is no longer impinged upon, the electric drive 1, 2, 3 assumes the base position or neutral position or starting position A.

FIG. 3 also shows the respective time sequence of a signal S transmitted by a signal generator 8 to a control unit 9. The signal generator 8 is assigned to a handle 10. In the example, the handle 10 acts upon a lever 11, designed as a blocking lever 11. As soon as the handle 10 is acted upon, and in the opening sense, the lever or the blocking lever 11 is pivoted around its axis 12 in clockwise direction, as apparent from the transition from FIG. 1 to FIG. 2.

As a result of the handle 10 being acted upon, as described, the blocking lever 11 acts upon the signal generator 8. The signal generator 8 in turn contains a leaf spring 13. As soon as the handle 10 is acted upon, the signal generator 8 generates a signal S, moving from "0" to "1" as shown in FIG. 3. The released handle 10 causes the signal S to drop back again from "1" to "0". At the same time, a first flank FS and a second flank FE are observed in FIG. 3 during the period of the signal S and during time t. The first flank Fs and the second flank FE of the signal S generated by the signal generator 8 are now evaluated as part of the invention and for triggering the electric drive 1, 2, 3. In the example, the evaluation is carried out by the control unit 9.

The overall design is such that the electric drive 1, 2, 3, is started by the first flank Fs of the signal S of the signal generator 8. This is apparent when comparing the time diagrams arranged underneath each other in FIG. 3. The first flank Fs does actually correspond to the electric drive 1, 2, 3 moving from its base position A into the end position E or being energized accordingly by the control unit 9. In contrast, the second flank FE of the signal S of the signal generator 8 ensures that the electric drive 1, 2, 3 is switched off. From FIG. 3 it is apparent that consequently the second flank FE coincides again with the transition of the electric drive 1, 2, 3 from the end position E to base position A.

FIG. 3 also shows that the energizing of the electric drive 1, 2, 3 during the assumption of its end position E, i.e. when the stop 5 of the driven pulley 3 rests against the counter stop 6 fixed on the housing, is divided into two phases, a start phase PS and a holding phase PH. During the start phase PS the electric drive 1, 2, 3 is actively energized with the aid of the control unit 9, by the control unit 9 respectively acting upon the electric motor 1. In contrast, the holding phase PH corresponds to the electric motor 1 in question being short-circuited, as a result of which holding forces are exerted on the electric drive 1, 2, 3 in the example in such a way that the force of the spring 7 is overcome so that the stop 5 still rests against the counter stop 6.

The start phase PS corresponds to a specified starting time tS. This starting time is can in the example last between 20 ms and 100 ms. Within the starting time tS it is ensured that the electric drive 1, 2, 3 is reliably moved from its base position A to the end position E. This start phase PS or starting time tS is followed immediately by the holding phase PH of the electric drive 1, 2, 3. A holding time tH corresponds to a holding phase PH. The holding time tH directly follows the starting time tS. During the holding phase PH the electric drive 1, 2, 3 retains its position—as already described—in such a way that the stop 5 rests against the counter stop 6 and that, as a result, the pawl lifted off with the aid of the driven pulley 3 is still retained in the lifted-off position.

Only when the control unit 9 registers the second flank FE of signal S of the signal generator 8 is the holding phase PH and thus also the holding time tH terminated.

In order to initiate the described functional change, the handle 10 is acted upon, which in turn acts upon the blocking lever 11 acting in turn upon the signal generator 8. In the embodiment, the blocking lever 11 ensures that incorrect energizing of the electric drive 1, 2, 3 can not cause an unintentional opening of the locking mechanism. Actually the blocking lever 11 engages in the electric drive 1, 2, 3 as shown in the functional position of FIG. 1 until the blocking lever 11 is moved clockwise around its axis 12 without the help of the handle 10. Only then and when the functional position shown in FIG. 2 is assumed, can the electric drive 1, 2, 3 start and open the locking mechanism. Any incorrect energizing can thus be combated as it corresponds to the handle 10 not being deflected. In the event of the electric drive 1, 2, 3 being subjected to such an incorrect energizing, the still engaged blocking lever 11 reliably ensures in such a case that the electric drive 1, 2, 3 is blocked and that the acted upon locking mechanism is not opened.

It is in any case ensured that after completion of the holding phase PH and thus also at the end of the holding time tH the electric drive 1, 2, 3 is moved into its neutral position or base position A. This is directly apparent from FIG. 3. This is actually achieved by the centre/zero spring 7 integrated in the driven pulley 3. In this base or neutral position A, a new starting command can be processed by the handle 10.

Only once the start phase PS and thus the starting time tS has been completed, is the electric drive 1, 2, 3 able to process a further and deviating signal S of the signal generator 8.

The invention claimed is:

1. Motor vehicle door lock comprising
a locking mechanism;
a handle;
a blocking lever connected to the handle;
an electric drive that moves the locking mechanism between a closed position and an open position;
at least one signal generator that produces a signal that defines a first flank and a second flank, wherein interaction between the blocking lever and the signal generator generates the signal when the handle is acted upon; and
a control unit that evaluates the first and second flank and controls operation of the electric drive based on the first and second flank wherein, upon detecting the first flank, the control unit is programmed to operate the electric drive a specified starting time sufficient to ensure that the locking mechanism reliably moves from the closed position to the open position and wherein the blocking lever blocks the locking mechanism from moving to the open position if the handle is not acted upon.

2. Motor vehicle door lock according to claim 1, wherein, after the specified starting time, the control unit is programmed to move the electric drive into a holding phase that maintains the locking mechanism in the open position.

3. Motor vehicle door lock according to claim 2, wherein the holding phase ends after the control unit detects the second flank of the signal generator.

4. Motor vehicle door lock according to claim 1, wherein the electric drive comprises at least one electric motor, and a worm gear driven by the motor as well as a driven pulley meshing with the worm gear.

5. Motor vehicle door lock according to claim 1, wherein interaction between a handle and the signal generator generates the signal when the handle is acted upon.

6. Motor vehicle door lock according to claim 1, wherein the signal generator contains a leaf spring for its actuation.

7. Method for the motorized actuating of the locking mechanism in the motor vehicle door lock according to claim 1, comprising, the control unit evaluating, the first flank and the second flank of the signal generated by the signal generator and controlling operation of the electric drive with the control unit based on the evaluated first and second flank.

8. Motor vehicle door lock according to claim 1, wherein the control unit starts the electric drive when the first flank is detected and switches off the electric drive when the second flank is detected.

9. Motor vehicle door lock according to claim 1, wherein, after the specified starting time, the electric drive moves into a holding phase that maintains the locking mechanism in the open position.

10. Motor vehicle door lock according to claim 9, wherein the holding phase ends after the second flank of the signal generator is received by the control unit.

11. Motor vehicle door lock according to claim 9, wherein the holding phase ends after both the end of the specified starting time and receipt of the second flank by the control unit.

12. Motor vehicle door lock according to claim 10, further comprising a spring that biases the locking mechanism to the closed position.

13. Motor vehicle door lock according to claim 10, wherein the specified starting time is between 20 ms and 100 ms.

14. Motor vehicle door lock according to claim 2, further comprising a spring that biases the locking mechanism to the closed position.

15. Motor vehicle door lock according to claim 2, wherein the specified starting time is between 20 ms and 100 ms.

* * * * *